US007759637B2

(12) United States Patent
Thomson

(10) Patent No.: US 7,759,637 B2
(45) Date of Patent: Jul. 20, 2010

(54) METHOD FOR STORING AND REACTING IONS IN A MASS SPECTROMETER

(75) Inventor: Bruce Thomson, Toronto (CA)

(73) Assignee: DH Technologies Development PTE. Ltd, Singapore (SG)

( * ) Notice: Subject to any disclaimer, the term of this patent is extended or adjusted under 35 U.S.C. 154(b) by 152 days.

(21) Appl. No.: 11/769,254

(22) Filed: Jun. 27, 2007

(65) Prior Publication Data

US 2008/0014656 A1 Jan. 17, 2008

Related U.S. Application Data

(60) Provisional application No. 60/806,343, filed on Jun. 30, 2006.

(51) Int. Cl.
*H01J 49/40* (2006.01)

(52) U.S. Cl. ..... 250/282; 250/292; 250/290

(58) Field of Classification Search ..... 250/290, 250/292, 282, 281
See application file for complete search history.

(56) References Cited

U.S. PATENT DOCUMENTS

| | | | | |
|---|---|---|---|---|
| 5,689,111 | A | 11/1997 | Dresch et al. | |
| 5,847,386 | A | 12/1998 | Thomson et al. | |
| 6,285,027 | B1 | 9/2001 | Chernushevich et al. | |
| 6,483,109 | B1 | 11/2002 | Reinhold et al. | |
| 6,627,875 | B2 | 9/2003 | Afeyan et al. | |
| 6,703,607 | B2 | 3/2004 | Stott et al. | |
| 6,797,950 | B2 | 9/2004 | Schwartz et al. | |
| 6,909,089 | B2 | 6/2005 | Londry et al. | |
| 7,064,317 | B2 | 6/2006 | McLuckey et al. | |
| 7,145,139 | B2 | 12/2006 | Syka | |
| 7,227,130 | B2 | 6/2007 | Hager et al. | |
| 7,365,319 | B2 * | 4/2008 | Hager et al. | 250/292 |
| 7,495,213 | B2 * | 2/2009 | Loboda | 250/292 |
| 2002/0074492 | A1 | 6/2002 | Taniguchi | |
| 2002/0175279 | A1 | 11/2002 | Hager | |
| 2004/0183005 | A1 | 9/2004 | Hager | |

(Continued)

OTHER PUBLICATIONS

Scott A. McLuckey, James L. Stephenson Jr., Keiji G. Asano, "Ion/Ion Proton-Transfer Kinetics: Implications for Analysis of Ions Derived from Electrospray of Protein Mixtures" Anal. Chem. 1998, 70, 1198-1202.

(Continued)

*Primary Examiner*—Kiet T Nguyen
(74) *Attorney, Agent, or Firm*—Bereskin & Parr LLP/S.E.N.C.R.L., s.r.l.

(57) ABSTRACT

A method of analyzing ions is provided having a first ion guide with first and second ends and introducing a first group of ions and a second group of ions of opposite polarity into the first ion guide, and applying an RF voltage potential to the first ion guide for confining the first and second groups of ions radially within the first ion guide. A first trapping barrier is provided to the first end of the first ion guide for trapping the first group of ions within the first ion guide and a second trapping barrier is provided to the second end of the first ion guide for trapping the second group of ions within the first ion guide and an axial field is provided for pushing the first group of ions toward the first trapping barrier and pushing the second group of ions toward the second trapping barrier.

55 Claims, 5 Drawing Sheets

U.S. PATENT DOCUMENTS

| | | | | |
|---|---|---|---|---|
| 2006/0169884 | A1 | 8/2006 | Syka | |
| 2007/0158545 | A1* | 7/2007 | Verentchikov | 250/282 |

OTHER PUBLICATIONS

Bruce E. Wilcox, John P. Quinn, Mark R. Emmett, Christopher L. Hendrickson, Alan G. Marshall, "Improved Ion Ejection Properties of a Linear Octopole Ion Trap Coupled to a Fourier Transform Ion Cyclotron Resonance Mass Spectrometer" Proceedings of the 50th ASMS Conference on Mass Spectrometery and Allied Topics, Orlando, Florida, Jun. 2-6, 2002.

International Search Report and Written Opinion issued for PCT/CA2007/001162, mailed Oct. 10, 2007.

* cited by examiner

METHOD FOR STORING AND REACTING IONS IN A MASS SPECTROMETER

RELATED APPLICATION

This application claims the benefit of U.S. Provisional Patent Application Ser. No. 60/806,343, filed Jun. 30, 2006, the entire content of which is hereby incorporated by reference.

FIELD

The applicant's teachings relate to a method and apparatus for storing and reacting ions in a mass spectrometer.

INTRODUCTION

Mass spectrometry is a prevalently used analytical method that identifies compounds based on the measurement of the mass-to-charge ratio of ions generated from the sample. In many cases, ions of only one polarity are analyzed at one time, and the voltages in the ion optical path can be optimized to provide transmission for ions of this polarity. For some applications, it is desirable to trap ions within some part of the ion path, usually in a 3D ion trap or 2D ion trap, for further processing or analysis. For example, in a 3D ion trap mass spectrometer or a 2D ion trap mass spectrometer, ions are trapped for time periods of typically a few tens or hundreds of milliseconds, and then are mass selectively scanned out of the trap to a detector for mass analysis. In other instances, it is desirable to trap ions and then fragment them before analysis. In other cases, it is desired to trap ions in order to react them with neutral molecules before analysis. In all of these cases, it is common to only trap and analyze ions of one polarity at a time.

In some cases, it is useful to be able to react positive and negative ions together in the same region of space, in order to provide partial charge neutralization or specific reactions between the ions. It is possible to trap ions of both polarities in one region of space in a 3D ion trap because the 3-dimensional RF fields in a 3D ion trap can trap ions of both polarities simultaneously. The magnitude and direction of the trapping force does not depend on the polarity of the ion.

Linear or 2D ion traps provide a much larger trapping volume and can therefore hold many more ions than can a 3D ion trap. However, in a 2D ion trap, the RF fields only act in the radial direction and not along the axis. Therefore, in a 2D trap, it is common to trap ions by applying a DC field at the entrance and exit that prevents the ions from leaving along the axis. This is usually done by providing a lens or another ion optical element at the entrance and exit to which a repulsive DC voltage is applied. This works well for ions of only one polarity. But if ions of both polarities are present in the 2D trap, then the repulsive field for ions of one polarity is an attractive field for ions of the opposite polarity, and will cause the ions of the opposite polarity to be lost from the trap. Since a DC field cannot be used to simultaneously trap ions of both polarities in the same region of space at the end of the 2D trap, there is a need to be able to trap both positive and negative ions together in a 2D trap, in order to provide the same kind of reactions that has been achieved in 3D traps.

SUMMARY

In accordance with an aspect of the applicant's teachings, there is provided a method of analyzing ions with a mass spectrometer. The method comprises providing a first ion guide having a first end and a second end and introducing a first group of ions and a second group of ions into the first ion guide, the second group of ions being opposite in polarity to the first group of ions. The method also comprises applying an RF voltage potential to the first ion guide for confining the first group of ions and the second group of ions radially within the first ion guide. The method also comprises providing a trapping barrier to the second end of the first ion guide for trapping the first group of ions within the first ion guide, wherein the trapping barrier is a DC voltage barrier of the same polarity as the first group of ions and providing an axial field for pushing the first group of ions toward the trapping barrier and for pushing the second group of ions toward the first end.

In another aspect, there is provided a method of analyzing ions with a mass spectrometer comprising providing a first ion guide having a first end and a second end and introducing a first group of ions and a second group of ions into the first ion guide, the second group of ions being opposite in polarity to the first group of ions. The method also comprises applying an RE voltage potential to the first ion guide for confining the first group of ions and the second group of ions radially within the first ion guide. The method also comprises providing a first trapping barrier to the first end of the first ion guide for trapping the first group of ions within the first ion guide, wherein the first trapping barrier is a first DC voltage barrier of the same polarity as the first group of ions, and providing a second trapping barrier to the second end of the first ion guide for trapping the second group of ions within the first ion guide, wherein the second trapping barrier is a second DC voltage barrier of the same polarity as the second group of ions and providing an axial field for pushing the first group of ions toward the first trapping barrier and pushing the second group of ions toward the second trapping barrier.

In accordance with another aspect of the applicant's teachings, there is provided a method of analyzing ions with a mass spectrometer comprising providing a first ion guide having a first end and a second end and introducing a first group of ions and a second group of ions into the first ion guide, the second group of ions being opposite in polarity to the first group of ions. The method also comprises applying an RF voltage potential to the first ion guide for confining the first group of ions and the second group of ions radially within the first ion guide. The method also comprises providing more than one trapping regions within the first ion guide for trapping the first and second groups of ions to be trapped in separate regions of the ion guide, wherein the more than one trapping regions are provided by providing multiple axial fields within the ion guide directed along the axis where the direction of the axial fields is reversed at one or more points within the ion guide.

In another aspect, there is provided a method of trapping ions of opposite polarity within an ion guide comprising providing an axial field within the ion guide and alternating the direction of the axial field in time with a period that is less than the drift time of the ions that are desired to be trapped from one end of the ion guide to the other end so that most of the ions remain trapped.

In another aspect, there is provided a method of analyzing ions with a mass spectrometer, the method comprising a) providing a first ion guide having a first end and a second end; b) introducing a first group of ions and a second group of ions into the first ion guide, the second group of ions being opposite in polarity to the first group of ions; c) applying an RF voltage potential to the first ion guide for confining the first group of ions and the second group of ions radially within the first ion guide; d) providing a first trapping barrier to the first end of the first ion guide for trapping the first group of ions within the first ion guide; e) providing a second trapping barrier to the second end of the first ion guide for trapping the second group of ions within the first ion guide; f) providing an axial field for pushing the first group of ions toward the first trapping barrier and pushing the second group of ions toward the second trapping barrier; and, g) after (f), mixing the first and second groups of ions within the first ion guide by adjusting the axial field.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in anyway.

DETAILED DESCRIPTION OF VARIOUS EMBODIMENTS

Figure 1:
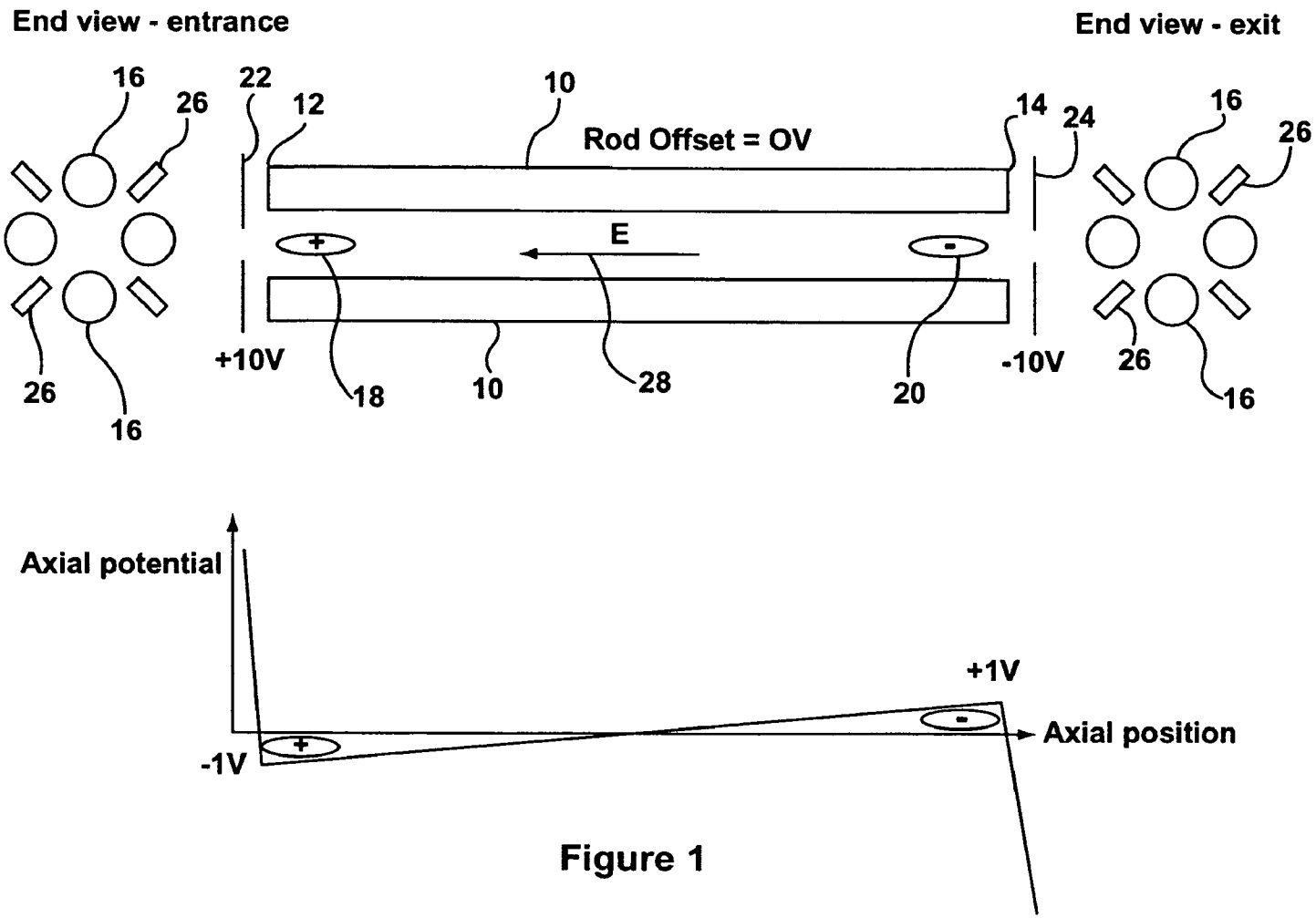
FIG. 1 schematically illustrates an ion guide simultaneously storing positive and negative ions in accordance with various embodiments.

It should be understood that the phrase "a" or "an" used in conjunction with the applicant's teachings with reference to various elements encompasses "one or more" or "at least one" unless the context clearly indicates otherwise. Referring to FIG. 1, in various embodiments in accordance with the applicant's teachings, a schematic diagram illustrates a first ion guide 10 having a first end 12 and a second end 14 for moving ions into and out of the first ion guide. In FIG. 1, the first ion guide 10, for example, comprises quadrupole rods 16. A first group of ions 18 and a second group of ions of opposite polarity 20 can be introduced into the first ion guide 10. An RF voltage potential can be applied to the first ion guide 10 to confine the first group of ions 18 and the second group of ions 20 within the first ion guide.

A first trapping barrier 22 can be provided at the first end 12 of the first ion guide 10 to trap the first group of ions 18, and a second trapping barrier 24 can be provided at the second end 14 of the first ion guide 10 to trap the second group of ions 20. In FIG. 1, the first trapping barrier 22 comprises a first ion optical element, which for example as shown, can be a first aperture lens. The second trapping barrier 24 comprises a second ion optical element, which for example as shown, can be a second aperture lens.

A DC voltage can be applied to the first trapping barrier 22. The polarity of the DC voltage is selected to repel the first group of ions 18 away from the first end 12 of the first ion guide 10, thereby impeding the first group of ions 18 from being ejected from the first ion guide 10 via the first end 12. Similarly, a DC voltage of the same polarity as the second group of ions 20 can be applied to the second trapping barrier 24 to repel the second group of ions 20 away from the second end 14 of the first ion guide 10. Of course, given that the first group of ions 10 and the second group of ions 20 are of opposite polarity, the first group of ions can be ejected via the second end 14, while the second group of ions can be ejected via the first end 12.

To trap the first 18 and second 20 groups of ions, as shown in FIG. 1, the ions can be introduced into the first ion guide 10 at an energy of a few electron volts (eV), and they can collide with a background gas to lose energy. At this point, the voltage on the first trapping barrier 22 is a repulsive voltage vis-a-vis the first group of ions, while the voltage on the second trapping barrier 24 is a repulsive voltage vis-a-vis the second group of ions, such that the first group of ions cannot escape via the first end of the first ion guide 10 while the second group of ions cannot escape via the second end of the first ion guide 10. The pressure in the first ion guide 10 can be conducive to trapping the groups of ions and typically can be greater than about $1\times10^{-3}$ Torr, but can be as low as about $1\times10^{-5}$ Torr.

The first ion guide 10 also comprises an axial field 28 which can be generated in many ways as known in the art. For example, the applicant's U.S. Pat. No. 5,847,386, shows many different methods of generating axial fields in an ion guide, or within different regions of an ion guide. In FIG. 1, as an example, auxiliary electrodes 26 are shown to generate the axial field 28. The axial field can push the first group of ions 18 towards the first trapping barrier 22, and it can push the second group of ions 20 towards the second trapping barrier 24.

In FIG. 1, the graph below shows the potential along the central axis of the first ion guide 10 as it appears to positive ions. For example, the first trapping barrier 22, shown as an aperture lens, has a voltage applied of +10V, and the second trapping barrier 24, also shown as an aperture lens, has a voltage applied of −10V. The quadrupole rods 16 have 0V rod-offset. The axial field 28 can be applied as known in the art and, as shown in FIG. 1, can provide a potential gradient along the axis between the first end and the second end to push the first group of ions 18, positive ions in the example shown in FIG. 1, towards the first trapping barrier 22. An electric field is a vector quantity that is conventionally shown with a direction that indicates the force experienced by positive charges in the field. Therefore the axial field, which is an electric field directed along the axis, is always shown with a direction that indicates the force experienced by positive ions due to the axial field. The force experienced by negative ions due to an axial field is always in the opposite direction to the axial field. The same axial field 28 acts on the second group of ions 20 in the opposite direction, pushing them toward the second end 14. The second trapping barrier 24 can be at a negative potential relative to the rod offset, which repels the negative ions. Therefore, an axial field directed from the second end towards the first end, and a repulsive DC barrier for positive ions at the first end and a repulsive DC potential for negative ions at the second end can produce trapping regions for ions of both polarities within the ion guide. When a buffer gas or collision gas is added to the ion guide, ions will lose their axial kinetic energy and slow down to thermal velocities so that they can be trapped at the entrance and exit. The first group of ions 18 can collect near the first end 12 of the first ion guide 10, and the second group of ions 20 can collect near the second end 14 of the first ion guide 10. The values used in FIG. 1 are examples, and other values can be used. In the example shown, the axial field can provide a voltage difference between the entrance and the exit of 2V. However, the axial field strength can be increased if it is desired to provide a stronger force in order to make ions move faster. A stronger axial field can cause ions to be collected in a smaller axial region of space. The voltages on the lenses can be increased in order to provide a higher barrier, which might be desired if the ions are introduced at high energy.

Figure 2:
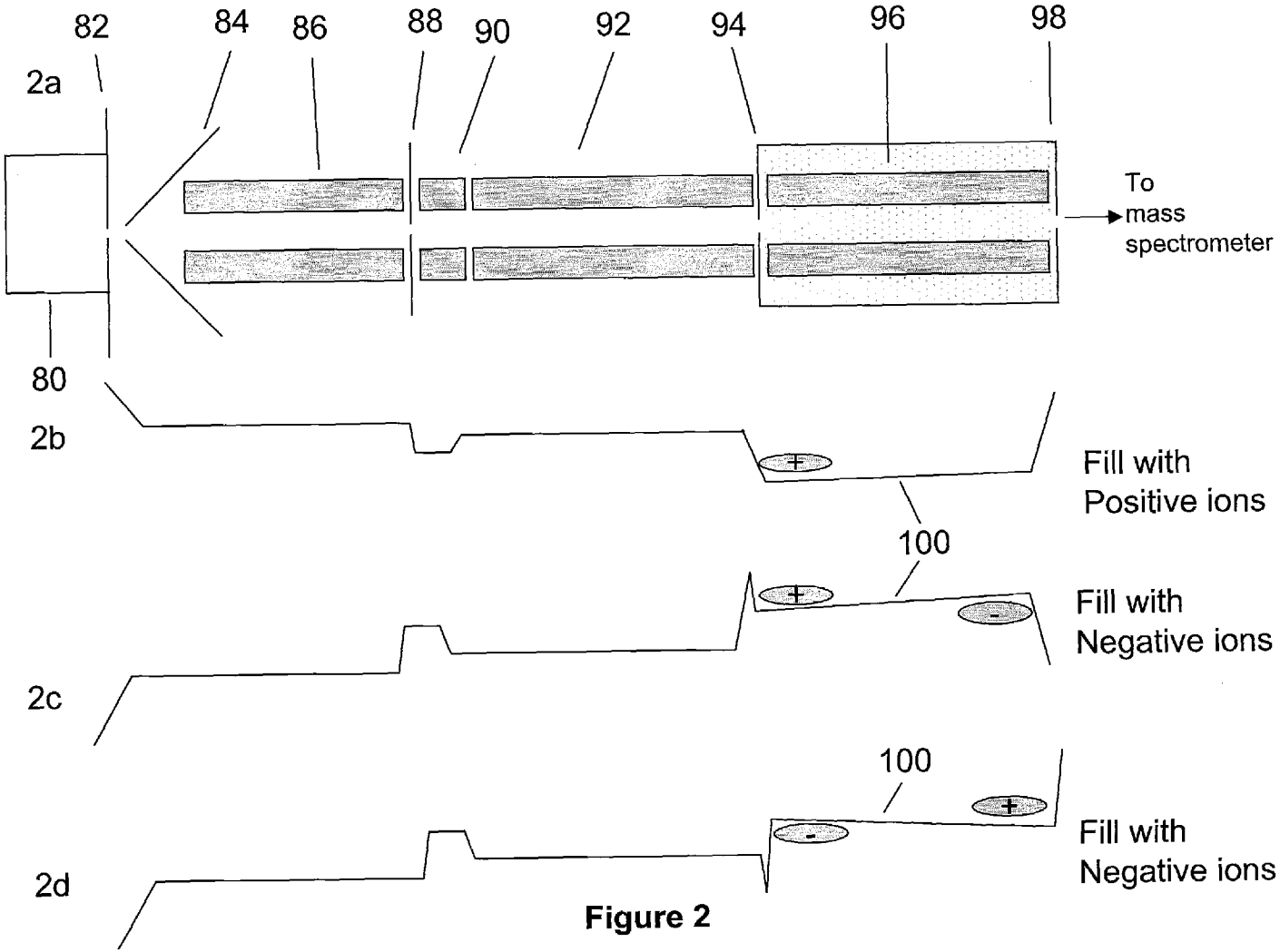
FIG. 2 schematically illustrates an example of storing positive and negative ions in an ion guide in accordance with various embodiments.

FIG. 2 shows in more detail how ions of two different polarities can be introduced from an ion source of a mass spectrometer and collected in an ion guide using the applicant's teachings. FIG. 2*a* shows an example of a mass spectrometer system consisting of an ion source 80 at atmospheric pressure, a sampling aperture 82 and skimmer 84, a Q0 RF-only quadrupole 86 for guiding and focusing the ions, an IQ1 lens 88 for separating the Q0 quadrupole 86 from a Q1 mass filter quadrupole 92 and allowing ions to pass through into Q1 92, stubbies 90 for assisting in transferring ions from Q0 86 to Q1 92, the Q1 mass filter 92 for first mass selection if desired, an IQ2 lens 94 for separating Q1 92 from a Q2 RF-only quadrupole 96 and allowing ions to pass through into Q2 96, the Q2 RF-only quadrupole 96 that can function as an ion guide or a collision cell, and an IQ3 lens 98 for separating Q2 96 from a mass spectrometer. After ions exit from Q2 96, they can be transmitted to another mass spectrometer which, for example, can be a TOF or a quadrupole mass filter or a linear ion trap mass spectrometer or the like. FIG. 2*b* shows how the potentials along the axis of the ion path can be arranged so that first positive ions from the ion source can be introduced into Q2 96 and can be trapped as shown near the entrance of Q2 96. Positive ions can flow into Q2 96 and can collide with the background gas in Q2 96, which can be at a pressure of the order of a few millitorr. The ions can slow down and lose kinetic energy and eventually can reach thermal velocities and then can be pushed by the axial field 100 toward the entrance of Q2, where the barrier on the ion optical element 94 at the entrance of Q2 can prevent the positive ions from escaping.

After introducing positive ions and trapping them for a period that can be of tens of milliseconds in duration, the ion source can be switched to produce negative ions. Alternatively, another source of negative ions can be activated while the positive ion source can be turned off. The ion path potentials can then be changed to be as shown in FIG. 2*c* so that negative ions can flow into Q2 96 while the positive ions can still be retained. A small local barrier at the entrance of Q2, applied to the ion optical element 94 can prevent positive ions from leaving, but can allow negative ions to leave at the entrance if they approached the ion optical element. Therefore, ideally the negative ions must lose sufficient energy so that they do not bounce back to the entrance of Q2 96 once they have entered Q2 96, although it is appreciated that ions could bounce back out the entrance of Q2 and return, repeating this process several times until sufficient energy is lost to allow the negative ions to be trapped within Q2. The ions can lose kinetic energy by the collisions with the gas molecules, and by the axial field that can push the negative ions toward the exit of Q2, where the negative potential on the IQ3 or exit lens 98 can prevent the negative ions from leaving. FIG. 2*d* shows an alternate scheme where the positive ions, once introduced, can be collected at the exit of the ion guide, while the negative ions can be collected at the entrance. Alternately, the negative ions can be introduced first and the positive ions can be introduced afterwards. By selecting appropriate potentials, either positive or negative ions can be introduced first, and either positive or negative ions can be collected at the entrance end, with the opposite polarity ions collected at the exit end. The ion path potentials that are required will be apparent to one skilled in the art. The ion path elements are not limited to the configuration shown in FIG. 2*a*, which is shown as an example.

Figure 3:
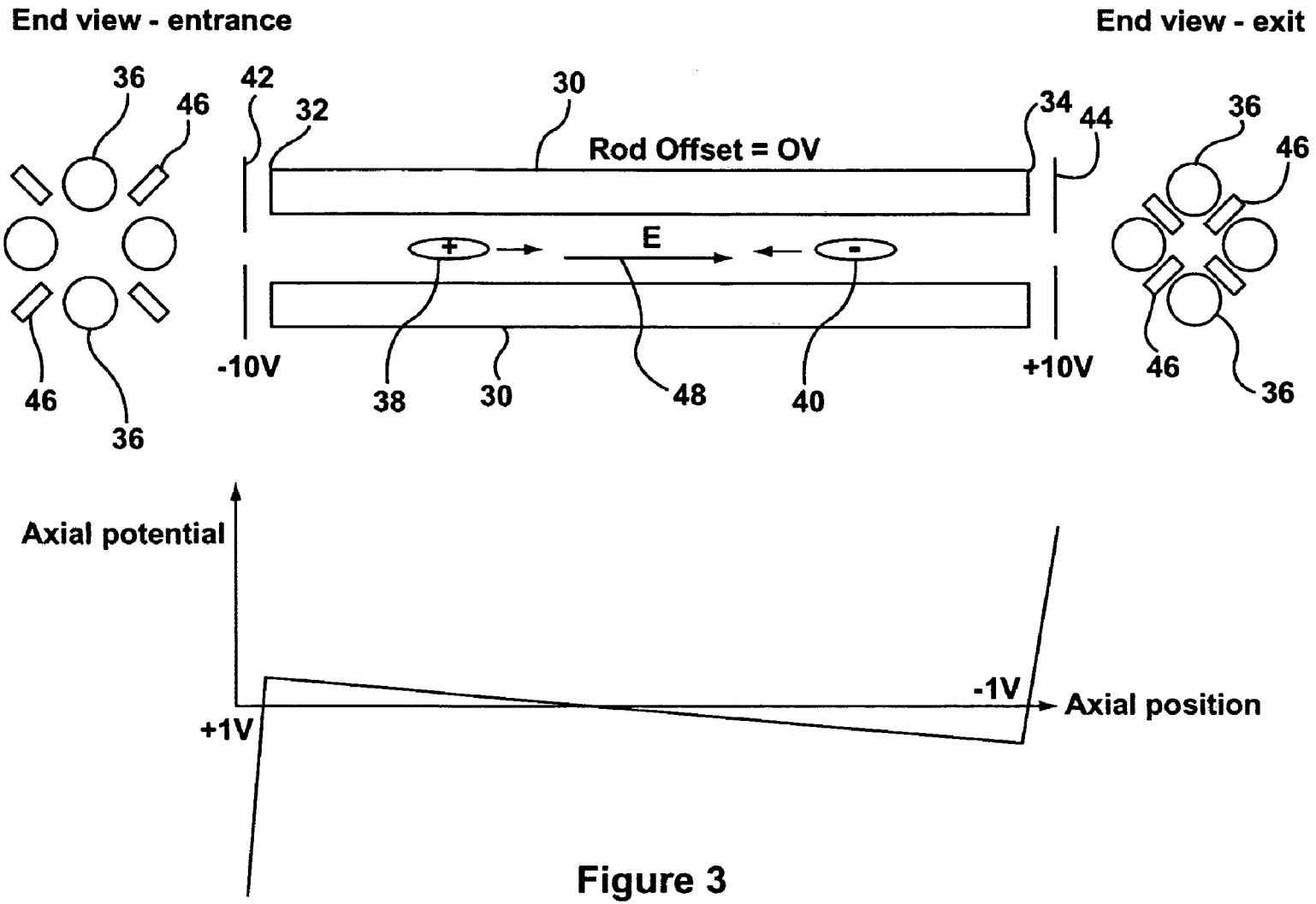
FIG. 3 schematically illustrates reacting positive and negative ions in accordance with various embodiments.

FIG. 3 illustrates, in various embodiments in accordance with the applicant's teachings, that after trapping both groups of ions of opposite polarity in different regions, as previously discussed, the potentials can be reversed causing the first group of ions 38, shown as positive ions in the example in FIG. 3, which can be trapped near the first end 32 of the first ion guide 30 to move near the second end 34 of the first ion guide 30. The graph below shows the potential along the central axis of the first ion guide 30 as seen by positive ions. In FIG. 3, the first ion guide 30 can be represented by quadrupole rods 36. Simultaneously, the second group of ions 40, shown as negative ions in the example in FIG. 3, which can be trapped near the second end 34 of the first ion guide 30 can move near the first end 32 of the first ion guide 30. The two clouds of ions can pass through one another, allowing them to mix and interact as they move through. The interaction between both groups of ions, positive and negative, can result in reaction and neutralization, at least partially. The degree of interaction can depend on how quickly they move past one another, which can be controlled by the strength of an axial field 48 and by the pressure within the ion guide. In FIG. 3, the axial field 48 can be provided by auxiliary electrodes 46 between the quadrupole rods 36. However, other methods of generating axial fields can also be used, as known in the art, including tilted or tapered rods, segmented multipole rods with different DC potentials, resistively coated rods that can produce an axial field by means of a voltage difference between the ends, ring guides with different DC voltages on the rings, or any other methods that can provide an axial electric field along some portion of the ion guide. The direction of the axial field 48 can be reversed before reversing the polarity of the voltages on the ion optical elements so that ions start to move away from the first 42 and second 44 trapping barriers before the potentials on the lenses are reversed. This can prevent ions from escaping from the ends as soon as the barriers at the ends are reversed in potential. Alternatively, the axial field can be reduced 0 (turned off) for a short time, allowing ions to diffuse away from the barriers toward the middle of the trap. This will allow the two oppositely charged ion clouds to start to interact and react with each other as they move toward and through each other. Before the ions diffuse toward the opposite ends of the trap, the axial field can be re-applied in the opposite direction, and the voltages on the ion optical elements can be reversed, resulting in separation of the ion clouds to opposite ends of the trap. In other embodiments, the axial field may simply be turned off for a short period of time to allow the ions to diffuse toward each other and interact, and then the axial field can be imposed in the same direction again to separate the ion clouds. By only turning off the axial field for a few milliseconds, ions will not have time to diffuse to the other end of the trap and be lost. Several cycles of turning the axial field off, and then back on, may be employed to allow the ion-ion reactions to occur in the trap without the necessity of reversing the potentials of the barrier voltages. To promote a more complete reaction, the axial field and the lens potentials can be reversed several times to move the groups of ions back and forth. In some cases, it can be possible to leave the barriers at the ends unchanged and rapidly reverse the direction of the axial field 48 so that ions are moved back and forth within the central regions, not giving enough time for the ions to escape from the ends. The axial field direction should be reversed with a period that is shorter than the drift time of the fastest ions of interest through the ion trap, in order that these ions not reach the ends before the field is reversed again. A safe maximum period of oscillation of the field can be determined experimentally or theoretically based on the length of the trap and the mobility of the ions. After sufficient reaction time, the first group of ions 38 can be released at one end of the first ion guide 30, preferably the second end 34, for mass analysis or for further reaction in another trapping region while holding the second group of ions 40 with the opposite polarity in the first ion guide 30. Then, the second group of ions can be released for mass analysis, if desired.

Figure 4:
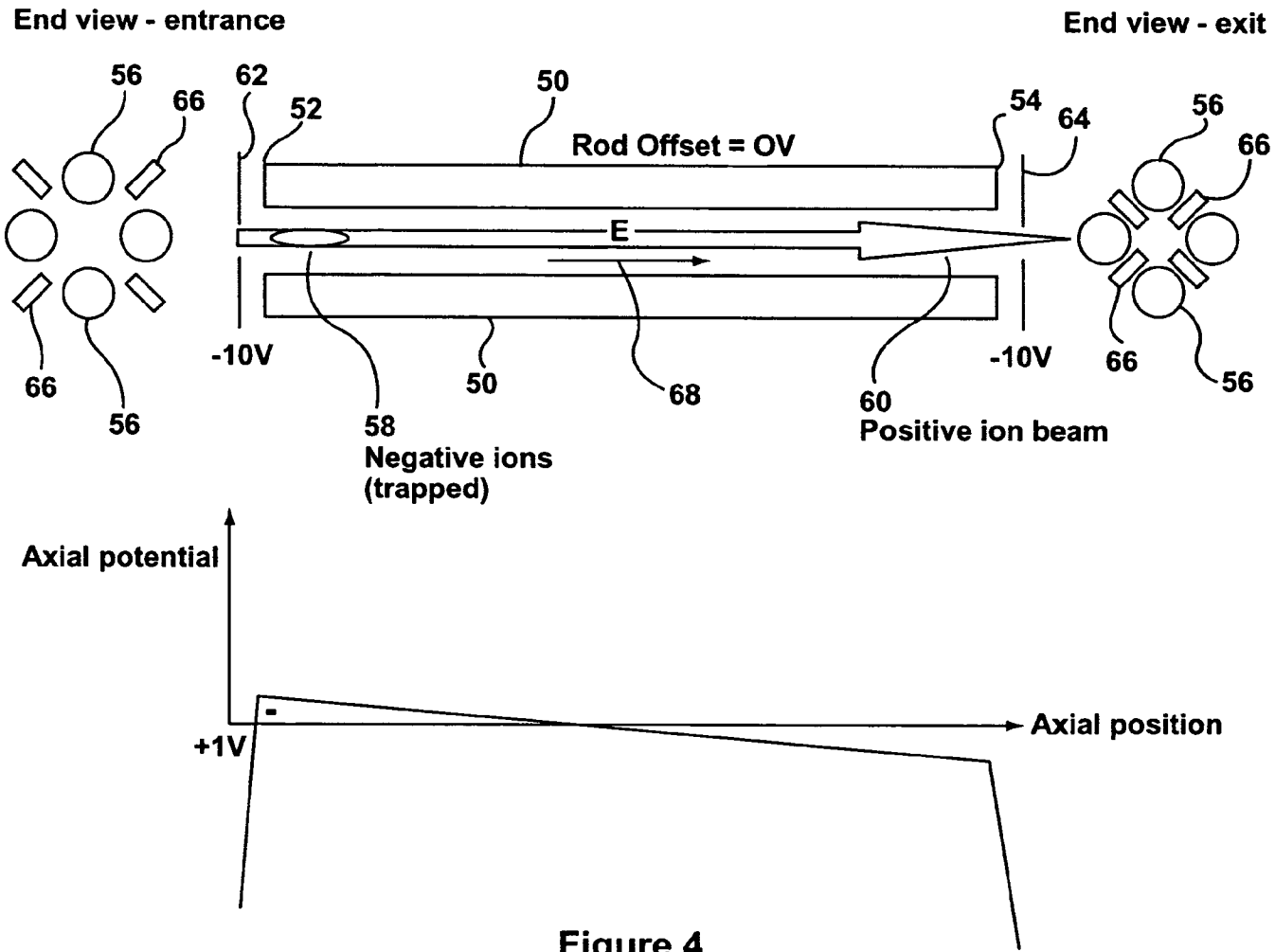
FIG. 4 schematically illustrates an example of trapping negative ions while positive ions flow through the ion guide in accordance with various embodiments.

FIG. 4 illustrates, in various embodiments in accordance with the applicant's teachings, that a first group of ions 58, negative ions in the example shown in FIG. 4, can be trapped by providing a first trapping barrier 62 near a first end 52 of the first ion guide 50. In various aspects, the first group of ions can also be trapped by providing a second trapping barrier 64 near a second end 54 of the ion guide. The first trapping barrier 62 comprises a first ion optical element, which for example as shown, can be a first aperture lens. A DC voltage can be applied to the first trapping barrier 62 to repel the first group of ions 58 away from the first 52 end of the first ion guide 50, thereby preventing the first group of ions 58 from being ejected from the first ion guide 50 via the first end 52. An axial field 68 can push the first group of ions 58 towards the first 62 trapping barrier. A second group of ions of opposite polarity 60, positive ions in the example shown, can flow continuously through the first group of ions 58, can mix with the first group of ions 58, and then can be ejected from the first ion guide 50. Then, the first group of ions 58 can also be ejected from the first ion guide 50. The graph below shows the potential along the central axis of the first ion guide 50. Alternatively, the first group of ions can be trapped near the second end of the first ion guide and the second group of ions can flow continuously through the first group of ions and be ejected from the second end of the first ion guide. In this case the axial field can be applied to push the first group of ions toward the second end of the ion guide, and a trapping barrier can be applied to repel the first group of ions away from the second end of the ion guide, resulting in the first group of ions being trapped near the second end of the ion guide. The second group of ions, of opposite polarity to the first group of ions, can flow continuously through the first ion guide and through the first group of ions, and can exit continuously from the second end of the ion guide. In this case the axial field will push the second group of ions toward the first end and away from the second end. However, it will be recognized that if the initial energy of the second group of ions is high enough, the momentum of the ions will be sufficient to overcome the axial field to carry the second group of ions through the ion guide without being stopped and without being trapped. In FIG. 4, the first ion guide 50 can be represented by quadrupole rods 56, and the axial field 68 can be provided by auxiliary electrodes 66 between the quadrupole rods 56. However, other methods of generating axial fields can also be used, as known in the art.

Figure 5:
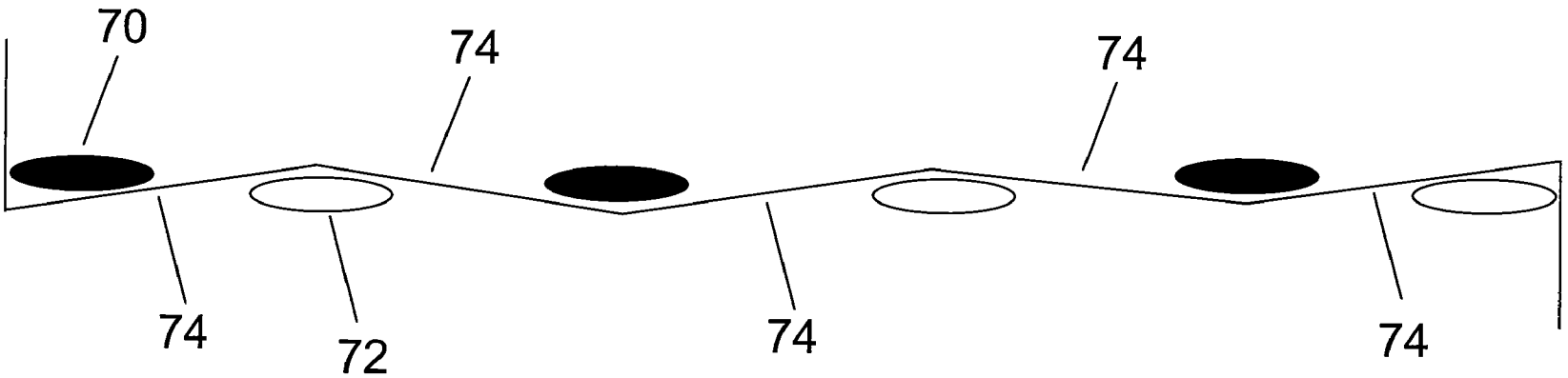
FIG. 5 schematically illustrates an example of multiple trapping regions within the ion guide in accordance with various embodiments.

FIG. 5 illustrates, in various embodiments in accordance with the applicant's teachings, that more than one trapping region can be produced within an ion guide in separate regions of the ion guide by reversing the direction of the axial fields throughout the ion guide. In FIG. 5, a first group of ions 70 of the same polarity, shown as dark ovals, and a second group of ions 72, all of the opposite polarity to the first group of ions, shown as white ovals, can be trapped in multiple trapping regions 74 within the ion guide. Multiple trapping regions can enhance the degree of reactions as groups of ions are moved back and forth.

In various embodiments, a first group of ions and a second group of ions of opposite polarity can be introduced into an ion guide. An RF voltage potential can be applied to the ion guide for confining the first and the second group of ions within the ion guide. Trapping regions can be provided within the ion guide to trap the first and second group of ions in separate regions of the guide. The trapping regions can be produced by applying axial fields within the ion guide in which the direction of the fields is reversed at one or more points within the ion guide. For example, the axial field can be provided by tilted segments in which the direction of the tilt is changed throughout the ion guide, or by segmented auxiliary electrodes with different voltages, or by segmented multipoles with different voltages, or by other means that would be apparent to one that is skilled in the art.

In various aspects, the trapping regions can be produced by one or more axial fields along the axis of the ion guide and DC voltages can be applied on the first and second ion optical elements. The axial fields can push the first and second group of ions of opposite polarities toward opposite ends of the ion guide.

In various aspects, after trapping the first and the second group of ions of opposite polarities in different regions of the ion guide, the axial field and the trapping potentials can be changed which can cause the first and the second group of ions of opposite polarities to move towards each other, pass through the same region within the ion guide, and interact and react with each other.

In various embodiments, polarity-independent barriers, which can be formed by AC or RF voltages applied to one or both of the ion optical elements at the ends, can be used to confine ions of different polarity within the ion guide. For example, an AC or RF voltage that is applied to a lens element at an end produces a barrier for both positive and negative ions, independent of polarity. Alternately, an AC or RF voltage applied to the rod offset can cause the offset of the ion guide to oscillate relative to the ion optical elements at the ends, and this can result in a polarity-independent RF barrier. In various embodiments, the ion optical elements at the ends can be multipoles. An alternating AC or RF voltage can be applied between the rod offsets of the ion guide and multipoles at the ends in order to produce a polarity independent barrier. If the ion guide consists of segmented multipoles, then an RF or AC voltage applied between the rod offsets of any adjacent segments can produce an RF barrier in the region at the interface between the segments, which can cause ions to be trapped within the ion guide. Any of these methods of forming polarity-independent barriers at the ends or within the trap can be used with or without axial fields within the ion guide to cause ions to be trapped. If no axial fields are used, the ions of both polarities can be trapped in the same region of space. Axial fields can be applied to cause ions of different polarities to separate in space, or to cause ions of different polarity to move toward and through one another.

In various embodiments, charge separation can be obtained from a mixture of positive and negative ions in the first ion guide with RF barriers at the ends. An axial field can then be applied to separate the ions into their respective charges. For example, a mixture of positive and negative ions can be introduced into an ion guide by. diffusion, or by causing the ions to be carried by gas flow. Polarity-independent barriers can then be applied to trap the mixture of ions together. An axial field can then be applied to cause the ions of different polarity to move apart from one another. The positive ions can then be released by reducing the barrier at one end, and then the negative ions can be released.

In various embodiments, once the first and second groups of ions are separated, they can be allowed to mix, interact, and react by turning off the axial field while maintaining trapping barriers.

In various embodiments, positive and negative ions can be trapped within an RF ion guide with an axial field that is rapidly reversed in direction, without the need for applying trapping barriers at the end. For example, if ions of one polarity are introduced into the ion guide and lose kinetic energy by collisions with the gas molecules before reaching the exit end, then a rapidly reversing axial field, oscillating with a period that is shorter than the drift time of ions from one end to the other end of the ion guide, will trap ions in the middle. Ions of the opposite polarity can then be introduced in the same fashion, and they will also be trapped by the oscillating axial field. If desired, ions of opposite polarity could then be separated into different regions of the ion guide by applying a constant axial field with trapping barriers at the end as shown, for example, in FIG. 1.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those skilled in the art.

In various embodiments, an ion guide can be, but is not limited to, a multipole. For example, an ion guide can be a quadrupole, a hexapole, or an octapole. An ion guide can be an RF ring guide or any RF guide in which RF fields are used to confine or focus ions radially to prevent radial escape of the ions. An ion guide can be, but is not limited to, a 2D trap, also known as a linear ion trap, or a collision cell.

In various embodiments, the first and second trapping barriers can be ion optical elements which can allow a DC voltage to be applied at the first end and/or second end of the ion guide. An ion optical element can be an aperture lens or another ion guide on which a different rod offset (DC) voltage can be placed or other configurations as known in the art.

In various embodiments, an axial field can be generated in many ways as known in the art. An axial field, for example, can, but need not be generated by tilted rods, auxiliary electrodes, segmented rods, resistively coated rods, and applying different potentials on RF ring guide plates. The axial field can be, but need not be, constant in magnitude over the length of the rods. For example, an axial field can be non-linear in space, and may even have a value of 0 at points where the direction of the axial field is reversed in space.

In various aspects, positive and negative ions can be introduced sequentially, or they can be simultaneously introduced together from the same end, or from two different directions, for example, the first and second ends or from the top and bottom of the first ion guide. The positive and negative ions can be introduced from different ends, from the same end, or from the middle of the ion guide, and then steered in the appropriate direction. The positive and negative ions can be stored, reacted if desired, and then analyzed.

In various embodiments, the mass spectrometer can be, but is not limited to, a linear ion trap, a time-of-flight mass spectrometer, a fourier transform mass spectrometer, a 3-D ion trap, a quadrupole mass spectrometer, or an orbitrap mass spectrometer.

All such modifications or variations are believed to be within the sphere and scope of the applicant's teachings as defined by the claims appended hereto.

The invention claimed is:

1. A method of analyzing ions with a mass spectrometer, the method comprising:

(a) providing a first ion guide having a first end and a second end;

(b) introducing a first group of ions and a second group of ions into the first ion guide, the second group of ions being opposite in polarity to the first group of ions;

(c) applying an RF voltage potential to the first ion guide for confining the first group of ions and the second group of ions radially within the first ion guide;

(d) providing a trapping barrier to the second end of the first ion guide for trapping the first group of ions within the first ion guide, wherein the trapping barrier is a DC voltage barrier of the same polarity as the first group of ions; and (e) providing an axial field for pushing the first group of ions toward the trapping barrier and for pushing the second group of ions toward the first end.

2. The method of claim 1 wherein the mass spectrometer comprises an ion optical element adjacent to the second end on the first ion guide, and step (d) comprises providing the trapping barrier by applying a DC voltage potential to the ion optical element to repel the first group of ions away from the second end of the first ion guide.

3. The method of claim 2 wherein step b) comprises providing a flow of the second group of ions through the trapping barrier at the second end of the first ions guide, and through the first group of ions and the first ion guide by configuring the DC voltage potential for attracting the second group of ions toward the second end of the first ion guide and allowing the second group of ions to continuously flow and mix with the first group of ions and ejecting the second group of ions from the first ion guide.

4. The method of claim 3 further comprising after ejecting the second group of ions from the first ion guide, configuring the axial field for attracting the first group of ions toward the second end of the first ion guide and ejecting the first group of ions from the first ion guide.

5. The method of claim 2 wherein the ion optical element comprises an aperture lens.

6. The method of claim 2 wherein the ion optical element comprises a second ion guide.

7. The method of claim 1 wherein step (d) further comprises providing a first end trapping barrier to the first end of the first ion guide wherein the first end trapping barrier is an AC voltage barrier.

8. The method of claim 7 wherein the mass spectrometer comprises an ion optical element adjacent to the first end of the first ion guide and step (d) comprises providing the first end trapping barrier by applying an AC voltage potential to the ion optical element.

9. The method of claim 1 wherein the first ion guide comprises multipole rods.

10. The method of claim 9 wherein the multipole is selected from the group comprising of quadrupole, hexapole, and octapole rods.

11. The method of claim 1 wherein the axial field is provided by tilted rods.

12. The method of claim 1 wherein the axial field is provided by auxiliary electrodes.

13. The method of claim 1 wherein the axial field is provided by applying different potentials on segmented multipoles.

14. The method of claim 1 wherein the axial field is provided by applying different potentials on RF ring guide plates.

15. The method of claim 1 wherein the first and second groups of ions are introduced sequentially.

16. The method of claim 1 wherein the first and second groups of ions are introduced simultaneously.

17. The method of claim 1 wherein the first ion guide is operated at a gas pressure of between about 10 Torr and about $1\times10^{-5}$ Torr.

18. The method of claim 1 wherein the first ion guide is operated at a gas pressure of between about 1 Torr and about $1\times10^{-3}$ Torr.

19. A method of analyzing ions with a mass spectrometer, the method comprising:

(a) providing a first ion guide having a first end and a second end;

(b) introducing a first group of ions and a second group of ions into the first ion guide, the second group of ions being opposite in polarity to the first group of ions;

(c) applying an RF voltage potential to the first ion guide for confining the first group of ions and the second group of ions radially within the first ion guide;

(d) providing a first trapping barrier to the first end of the first ion guide for trapping the first group of ions within the first ion guide, wherein the first trapping barrier is a first DC voltage barrier of the same polarity as the first group of ions; and (e) providing a second trapping barrier to the second end of the first ion guide for trapping the second group of ions within the first ion guide, wherein the second trapping barrier is a second DC voltage barrier of the same polarity as the second group of ions; and (f) providing an axial field for pushing the first group of ions toward the first trapping barrier and pushing the second group of ions toward the second trapping barrier.

20. The method of claim 19 wherein the mass spectrometer comprises a first ion optical element adjacent to the first end of the first ion guide and wherein the mass spectrometer comprises a second ion optical element at the second end of the first ion guide and step (d) comprises providing the first trapping barrier by applying a first DC voltage potential to the first ion optical element and step (e) comprises providing the second trapping barrier by applying a second DC voltage potential to the second ion optical element.

21. The method of claim 20 further comprising reversing the first and second DC voltage potentials and the direction of the axial field to push the first group of ions toward the second trapping barrier and to push the second group of ions toward the first trapping barrier such that the first group of ions and the second group of ions mix and move to opposite ends of the first ion guide.

22. The method of claim 21 wherein the first and second DC voltage potentials and the axial field potential are further reversed one or more times to facilitate further interaction of the first and second groups of ions.

23. The method of claim 22 wherein after the first and the second groups of ions has have mixed and interacted, the second trapping barrier potential is reduced in order to eject the second group of ions from the first ion guide for mass analysis.

24. The method of claims 21 wherein after the first and the second groups of ions have mixed and interacted, the second trapping barrier potential is reduced in order to eject the second group of ions from the first ion guide for mass analysis.

25. The method of claim 24 further comprising configuring the axial field for attracting the first group of ions towards the second end of the first ion guide and ejecting the first group of ions from the first ion guide for mass analysis after the second group of ions is ejected from the first ion guide.

26. The method of claim 20 wherein the first and second ion optical elements comprise an aperture lens.

27. The method of claim 20 wherein the first and second ion optical elements comprise a second ion guide.

28. The method of claim 19 wherein the first ion guide comprises multipole rods.

29. The method of claim 28 wherein the multipole is selected from the group comprising of quadrupole, hexapole, and octapole rods.

30. The method of claim 19 wherein the axial field is provided by tilted rods.

31. The method of claim 19 wherein the axial field is provided by auxiliary electrodes.

32. The method of claim 19 wherein the axial field is provided by applying different potentials on segmented multipoles.

33. The method of claim 19 wherein the axial field is provided by applying different potentials on RF ring guide plates.

34. The method of claim 19 wherein the first and second groups of ions are introduced sequentially.

35. The method of claim 19 wherein the first and second groups of ions are introduced simultaneously.

36. The method of claim 19 wherein the first ion guide is operated at a gas pressure ranging of between about 10 Torr and about $1\times10^{-5}$ Torr.

37. The method of claim 19 wherein the first ion guide is operated at a gas pressure of between about 1 Torr and about $1\times10^{-3}$ Torr.

38. The method of claim 19 wherein the axial field is turned off to allow the first and second group of ions to further mix and interact within the ion guide.

39. The method of claim 19 wherein the axial field is reversed one more time in order to cause trapped ions at each end to move toward the opposite end and mix and interact.

40. A method of analyzing ions with a mass spectrometer, the method comprising:

(a) providing a first ion guide having a first end and a second end;

(b) introducing a first group of ions and a second group of ions into the first ion guide, the second group of ions being opposite in polarity to the first group of ions;

(c) applying an RF voltage potential to the first ion guide for confining the first group of ions and the second group of ions radially within the first ion guide; and (d) providing more than one trapping regions within the first ion guide for trapping the first and second groups of ions to be trapped in separate regions of the ion guide, wherein step (d) comprises providing the more than one trapping regions by providing multiple axial fields within the ion guide directed along the axis where the direction of the axial fields is reversed at one or more points within the ion guide.

41. The method of claim 40 further providing a first ion optical element at the first end of the ion guide and a second ion optical element at the second end of the ion guide.

42. The method of claim 41 wherein step (d) further comprises applying DC voltages to the first and second ion optical elements at the first and second ends of the ion guide.

43. The method of claim 42 wherein after trapping the first and second groups of ions of opposite polarities in different regions of the ion guide, the axial field and DC voltages are reversed in order to cause the first group and the second group of ions of opposite polarities to move towards each other.

44. The method of claim 43 wherein the first and second groups of ions of opposite polarities pass through the same region of the ion guide so as to interact and react with one another.

45. The method of claim 41 wherein step (d) further comprises applying AC voltages to the first and second ion optical elements at the first and second ends of the ion guide.

46. The method of claim 45 wherein after trapping the first and second groups of ions of opposite polarities in different regions of the ion guide, the axial field is reversed in order to cause the first group and the second group of ions of opposite polarities to move towards each other.

47. The method of claim 46 wherein the first and second groups of ions of opposite polarity pass through the same region of the ion guide so as to interact and react with one another.

48. A method of trapping ions of opposite polarity within an ion guide comprising providing an axial field within the ion guide and alternating the direction of the axial field in time with a period that is less than the drift time of the ions that are desired to be trapped from one end of the ion guide to the other end so that most of the ions remain trapped.

49. A method of analyzing ions with a mass spectrometer, the method comprising:

(a) providing a first ion guide having a first end and a second end;

(b) introducing a first group of ions and a second group of ions into the first ion guide, the second group of ions being opposite in polarity to the first group of ions;

(c) applying an RF voltage potential to the first ion guide for confining the first group of ions and the second group of ions radially within the first ion guide;

(d) providing a first trapping barrier to the first end of the first ion guide for trapping the first group of ions within the first ion guide;

(e) providing a second trapping barrier to the second end of the first ion guide for trapping the second group of ions within the first ion guide;

(f) providing an axial field for pushing the first group of ions toward the first trapping barrier and pushing the second group of ions toward the second trapping barrier; and, (g) after (f), mixing the first and second groups of ions within the first ion guide by adjusting the axial field.

50. The method as defined in claim 49 wherein the first trapping barrier is a first AC voltage barrier, and the second trapping barrier is a second AC voltage barrier.

51. The method as defined in claim 50 wherein (g) comprises turning off the axial field.

52. The method as defined in claim 51 wherein (f) and (g) comprise repeatedly providing and turning off the axial field to repeatedly mix and separate the first and second groups of ions.

53. The method of claim 50 wherein (g) comprises reversing the axial field one or more times to push trapped ions at each end to move toward the opposite end to mix the first and second groups of ions within the first ion guide.

54. The method as defined in claim 49 wherein (g) comprises turning off the axial field.

55. The method of claim 49 wherein (g) comprises reversing the axial field one or more times to push trapped ions at each end to move toward the opposite end to mix the first and second groups of ions within the first ion guide.

* * * * *